US010855000B1

(12) United States Patent
Randolph et al.

(10) Patent No.: US 10,855,000 B1
(45) Date of Patent: Dec. 1, 2020

(54) GROUNDING TERMINAL

(71) Applicant: TE CONNECTIVITY CORPORATION, Berwyn, PA (US)

(72) Inventors: Kurt Allan Randolph, Etters, PA (US); Brian Keith Weaver, Harrisburg, PA (US); Chong Hun Yi, Mechanicsburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/444,197

(22) Filed: Jun. 18, 2019

(51) Int. Cl.
*H01R 4/28* (2006.01)
*H01R 13/648* (2006.01)

(52) U.S. Cl.
CPC ..... *H01R 4/28* (2013.01); *H01R 13/648* (2013.01)

(58) Field of Classification Search
CPC ..... H01R 4/28; H01R 4/185; H01R 4/188; H01R 4/18; H01R 4/38; H01R 43/048; H01R 13/648
USPC ..... 439/878
See application file for complete search history.

(56) References Cited

U.S. PATENT DOCUMENTS 492,715 A * 2/1893 Poupitch ..... F16B 39/24 411/231
1,631,819 A * 6/1927 Ivory ..... F16B 39/24 411/149
4,072,081 A * 2/1978 Curtis ..... F16B 31/028 411/10
7,568,870 B2 * 8/2009 Paquet ..... F16B 37/043 411/177
7,905,695 B2 * 3/2011 O Brien ..... F16B 39/26 411/149
8,016,530 B2 * 9/2011 Johnson ..... F16B 37/043 411/173
9,267,529 B2 * 2/2016 Tejero Salinero .... F16B 37/041
9,488,208 B2 * 11/2016 Hemingway ..... F16B 1/0014
2008/0095592 A1 * 4/2008 Spitz ..... F16B 37/043 411/174
2009/0003961 A1 * 1/2009 Benkel ..... F16B 37/02 411/190

* cited by examiner

*Primary Examiner* — Peter G Leigh
(74) *Attorney, Agent, or Firm* — Saxton & Stump, LLC

(57) ABSTRACT

An embodiment is directed to a grounding terminal for mounting on a grounding surface. The grounding terminal has a top wall having a first mounting opening and a bottom wall having a second mounting opening. The second mounting opening is in alignment with the first mounting opening to receive mounting hardware therethrough. A first side wall extends between the top wall and the bottom wall at angles other than 90 degrees. A second side wall extends between the top wall and the bottom wall at angles other than 90 degrees. As the mounting hardware is tightened, the shape and positioning of the side walls relative to the top wall and bottom wall reduces the amount of torque required to move the top wall toward the bottom wall to allow for the mounting hardware to be tightened without the need for special tooling.

20 Claims, 3 Drawing Sheets

GROUNDING TERMINAL

FIELD OF THE INVENTION

The present invention is directed a grounding terminal for use in establishing an interconnection between a wire and a metallic panel or casing.

BACKGROUND OF THE INVENTION

A common way in which components of an electrical assembly are grounded is to attach a ground wire to a groundable surface, such as a metallic portion of the chassis, panel or casing. These grounding connections are conventionally made using a prior art grounding clip which comprises a ring tongue terminal having a crimp barrel or screw clamp extending from an end of the ring terminal. The ring tongue terminals are secured to the chassis by a screw or other known mounting members.

Many known grounding terminals require two screws to mount the grounding terminals to the groundable surface and to terminate the ground wire to the grounding terminals. Such a configuration requires transmission of the electrical current from the grounding wire connection, through the body length of the grounding terminal, and then down through the terminal lug and into the grounding surface. This requires a highly conductive and expensive material to ensure for the proper flow of the grounding current.

In addition, conventional grounding clips often have a crimp barrel extending from an outboard end of the ring terminal, such that a force applied to the wire can cause bending of the crimp barrel, thus causing permanent damage to the grounding clip. Alternatively, the crimp barrel may be damaged prior to insertion of the wire therein.

It would be beneficial to provide a grounding terminal in which the grounding current passes directly from the device surface or grounding surface to the grounding wire with minimal load through the grounding terminal. In addition, it would be beneficial to provide a grounding terminal which is easy to secure, which can be pre-assembled to a groundable surface without permanent deformation and which is not bent or damaged during transportation or use.

SUMMARY OF THE INVENTION

An embodiment is directed to a grounding terminal for mounting on a grounding surface. The grounding terminal has a top wall having a first mounting opening and a bottom wall having a second mounting opening. The second mounting opening is in alignment with the first mounting opening to receive mounting hardware therethrough. A first side wall extends between the top wall and the bottom wall at angles other than 90 degrees. A second side wall extends between the top wall and the bottom wall at angles other than 90 degrees. As the mounting hardware is tightened, the shape and positioning of the side walls relative to the top wall and bottom wall reduces the amount of torque required to move the top wall toward the bottom wall to allow for the mounting hardware to be tightened without the need for special tooling.

An embodiment is directed to a grounding terminal for mounting on a grounding surface. The grounding terminal has a top wall having a first mounting opening and a bottom wall having a second mounting opening. The second mounting opening is in alignment with the first mounting opening to receive mounting hardware therethrough. A first side wall extends between the top wall and the bottom wall at angles other than 90 degrees. Recesses are provided on the first side wall. The first side wall has a first curved transition portion which extends from the top wall and a second curved transition portion which extends from the bottom wall. A second side wall extends between the top wall and the bottom wall at angles other than 90 degrees. The second side wall has a curved transition portion which extends from the bottom wall and a curved transition portion positioned proximate the top wall. Partitions extends from the second side wall toward the first side wall. As the mounting hardware is tightened, the shape and positioning of the side walls relative to the top wall and bottom wall reduces the amount of torque required to move the top wall toward the bottom wall to allow for the mounting hardware to be tightened without the need for special tooling.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
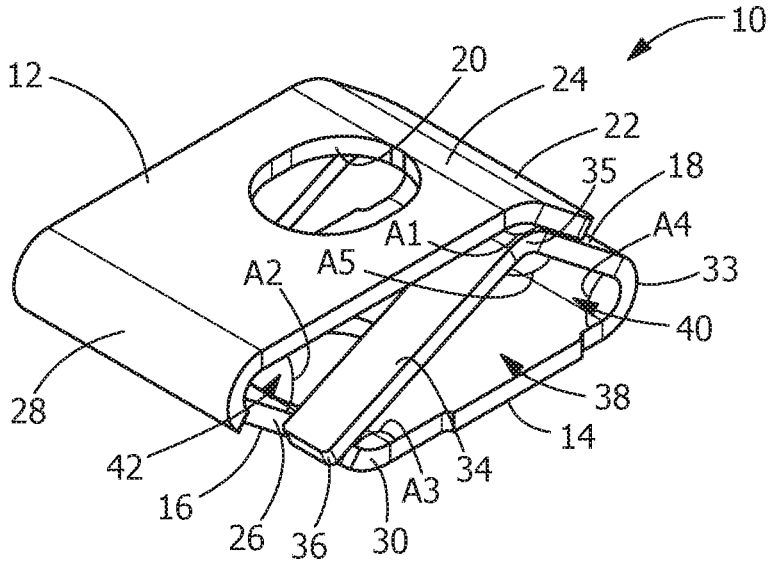
FIG. 1 is a top perspective view of an illustrative grounding terminal of the present invention.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

Figure 2:
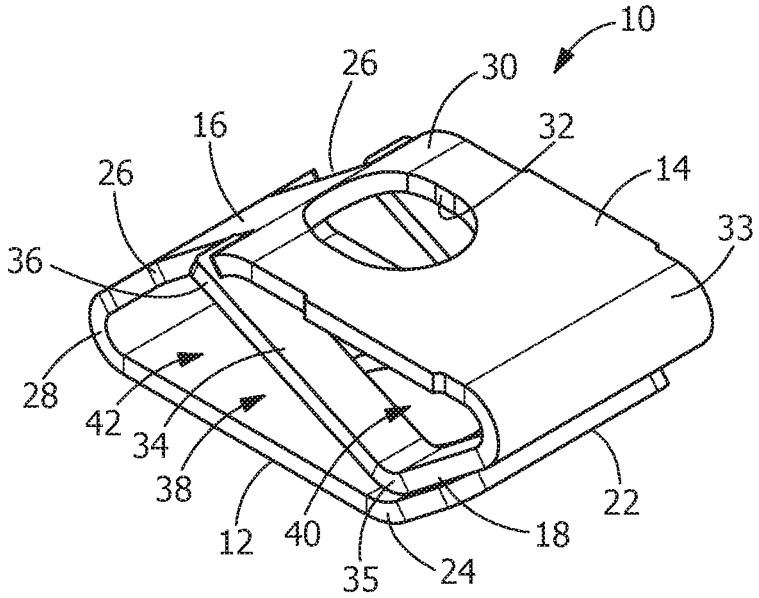
FIG. 2 is a bottom perspective of the grounding terminal of FIG. 1.

As shown in FIGS. 1 and 2, a grounding terminal 10 has a top wall 12, a bottom wall 14, a first side wall 16 and a second side wall 18. In the illustrative embodiment shown, the side walls 16, 18 extend at an angle other than 90 degrees from the top wall 12 and the bottom wall 14, whereby the top wall 12 is parallel to the bottom wall 14 and the first side wall 16 is parallel to the second side wall 18 to form a trapezoidal shape when viewed from the side of the grounding terminal 10. However, other shapes of the grounding terminal 10 may be used without departing from the scope of the invention. The grounding terminal 10 is stamped and formed from a single piece of conductive material, such as, but not limited to 1/32 inch phosphor bronze. The configuration of the grounding terminal 10 allows for the terminal 10 to be formed using a progressive stamping die.

As best shown in FIG. 1, the top wall 12 has a first mounting opening 20 which extends therethrough. The opening 20 is dimensioned to receiving mounting hardware therein. A side wall engagement portion 22 extends from one end of the top wall 12. The side wall engagement portion 22 extends from the top wall 12 at an angle A1 of greater than 90 degrees. The side wall engagement portion 22 has an arcuate or curved transition portion 24 which extends from the top wall 12.

Side wall 16 extends from the opposite end of the top wall 12 from the side wall engagement portion 22. The side wall 16 extends at an angle A2 of less than 90 degrees from the top wall 12 and an angle A3 of greater than 90 degrees from the bottom wall 14. Recesses 26, as best shown in FIG. 2, are provided on either side of the side wall 16. The side wall 16 has an arcuate or curved transition portion 28 which extends from the top wall 12 and an arcuate or curved transition portion 30 which extends from the bottom wall 14.

The bottom wall 14 has a second mounting opening 32 which extends therethrough. The opening 32 is aligned with the opening 20 of the top wall 12. The opening 32 is dimensioned to receiving mounting hardware therein.

Side wall 18 extends from the opposite end of the bottom wall 14 from the side wall 16. The side wall 18 extends at an angle A4 of less than 90 degrees from the bottom wall 14. The side wall 18 is positioned proximate to the top wall 12 and forms an angle A1 of greater than 90 degrees with the top wall 12. The side wall 18 has an arcuate or curved transition portion 33 which extends from the bottom wall 14 and an arcuate or curved transition portion 35 positioned proximate the top wall 12.

Extending from the end of the side wall 18 which is proximate to the top wall 12 are divider legs or partitions 34. In the embodiment shown two divider partitions 34 are provided. The partitions 34 extend at an angle A5 of greater than 90 degrees from the side wall 16. The partitions 34 extend from the end of the side wall 18 which is proximate to the top wall 12 toward the intersection of the side wall 16 and the bottom wall 14. Ends 36 of the legs extend through or are positioned in the recesses 26 of the side wall 16.

The partitions 34 extend diagonally in a receiving opening 38 formed by the top wall 12, the bottom wall 14, the side wall 16 and the side wall 18 to divide the opening 38 into a first conductor receiving opening 40 and a second conductor receiving opening 42. The partitions 34 are spaced apart a sufficient distance to allow the mounting hardware 44 (FIGS. 3 and 4) to extend through the opening 20 in the top wall 12, the opening 38 and the opening 32 in the bottom wall 14.

Figure 3:
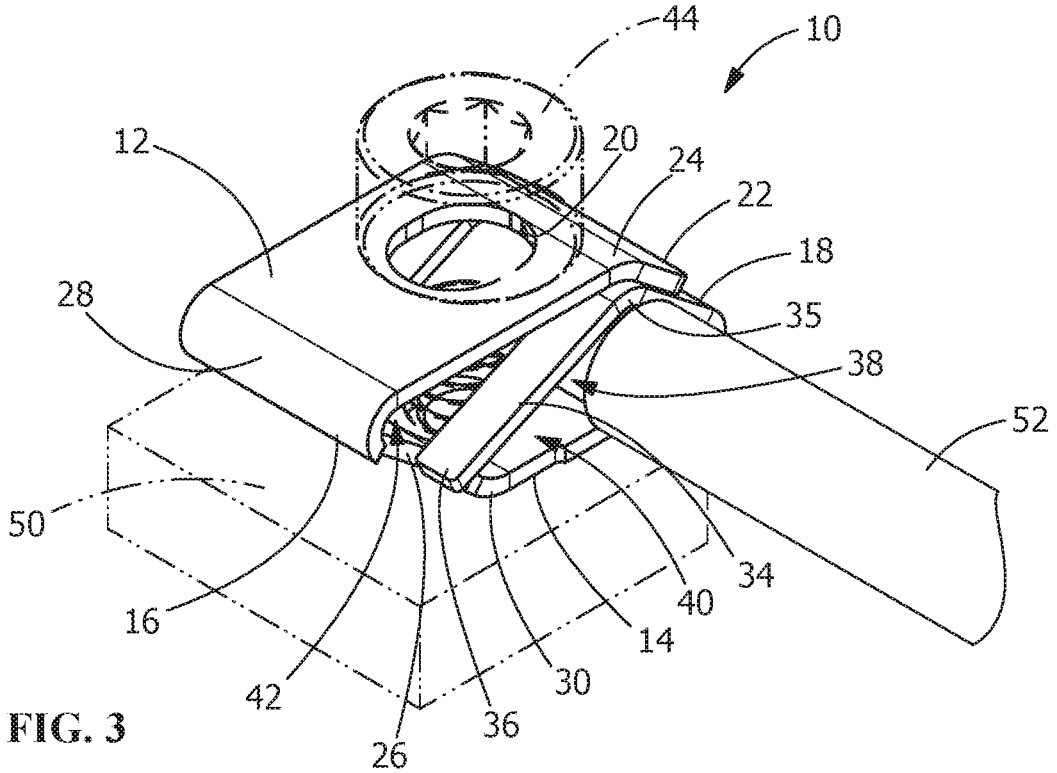
FIG. 3 is a top perspective of the grounding terminal of FIG. 1 mounted on a grounding surface with a grounding wire terminated in the grounding terminal.
Figure 4:
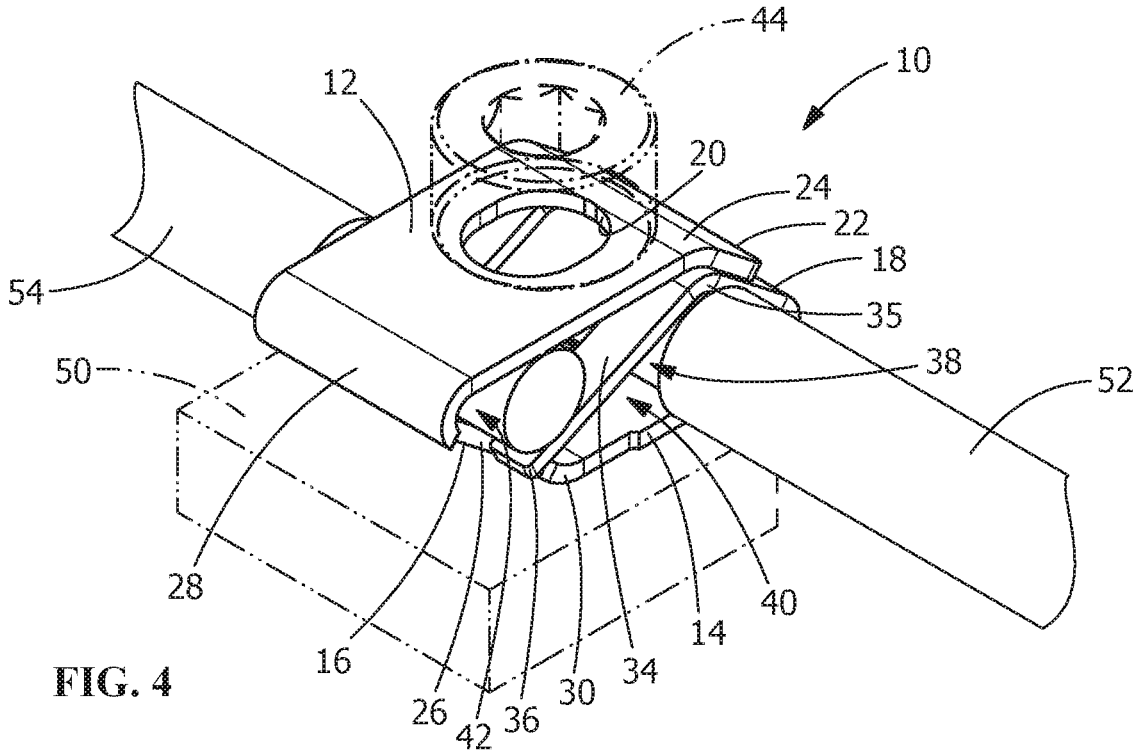
FIG. 4 is a top perspective of the grounding terminal of FIG. 1 mounted on a grounding surface with two grounding wires terminated in the grounding terminal.

In use, the grounding terminal 10 is positioned in engagement with a grounding surface 50. A portion of the grounding surface 50 is shown in FIGS. 3 and 4. The grounding surface 50 can be, but is not limited to, a conductive or metallic surface of a chassis, panel or casing. Either the top wall 12 or the bottom wall 14 may be placed in mechanical and electrical engagement with the grounding surface 50.

With the grounding terminal 10 properly positioned, the mounting hardware 44, such as, but not limited to a screw, is inserted through the opening 20 in the top wall 12, the opening 38 and the opening 32 in the bottom wall 14 and into a threaded opening (not shown) in the grounding surface 50. The mounting hardware 44 is tightened to maintain the grounding terminal 10 in position. The mounting hardware 44 is only tightened a sufficient amount to retain the grounding terminal 10 in position without significantly deforming the grounding terminal 10. This allows the grounding surface 50 to be transported or moved with the grounding terminal 10 attached thereto. As the grounding terminal has a geometric shape with minimal weak edges or portions exposed, the transportation or movement of the grounding surface 50 does not result in damage to the grounding terminal 10.

In the embodiment shown, the angles A1 and A3 are approximately equal, and the angles A2 and A4 are approximately equal. The partition 34 divides the opening 38 into two isosceles triangles, thereby allowing the grounding terminal 10 to evenly and predictably compress when the mounting hardware 44 is tightened. However, other configurations of the partitions 24 and opening 38 may be used.

With the grounding surface 50 and grounding terminal 10 properly positioned, a first grounding wire or conductor 52 can be terminated to the grounding terminal 10. As best shown in FIG. 3, the grounding conductor 52 is inserted into the first conductor receiving opening 40 of the grounding terminal 10. In some embodiments, the mounting hardware 44 may be required to be loosened to enlarge the first conductor receiving opening 40.

With the grounding conductor 52 properly inserted into the first conductor receiving opening 40, the mounting hardware 44 is tightened, causing the top wall 12 to move toward the bottom wall 14. Due to the shape and positioning of the side walls 16, 18 relative to the top wall 12 and bottom wall 14, the amount of torque required to move the top wall 12 toward the bottom wall 14 is controlled to allow for the mounting hardware 44 to be tightened without the need for special tooling.

As the mounting hardware 44 is tightened, the side wall engagement portion 22 frictionally engages the side wall 18. Consequently, the tightening of the hardware 44 and the movement of the top wall 12 causes the side wall engagement portion 22 to force the side wall 18 to pivot or rotate about the bottom wall 14, which in turn causes the partitions 34 to move toward the bottom wall 14. The movement of the partitions 34 and the side wall 18 causes the first conductor receiving opening 40 to become smaller, allowing the partitions 34, the side wall 18 and the bottom wall 14 to mechanically and electrically engage the grounding conductor 52 and retain the grounding conductor 52 in the first conductor receiving opening 40.

The configuration of the grounding terminal 10, including the side wall 16, side wall 18, side wall engagement portion 22 and legs 35 allows the grounding terminal 10 to be resiliently deformed as the hardware 44 is tightened for installation to a device for shipping, without taking a permanent set. This allows the grounding terminal 10 to return toward it original, unstresses position when the mounting hardware 44 is loosened, allowing the grounding terminal 10 to be used as intended for final permanent termination.

Alternatively, with the grounding surface 50 and grounding terminal 10 properly positioned, a first grounding wire or conductor 52 and a second grounding wire or conductor 54 can be terminated to the grounding terminal 10. As best shown in FIG. 4, the first grounding conductor 52 is inserted into the first conductor receiving opening 40 of the grounding terminal 10 and the second grounding conductor 54 is inserted into the second conductor receiving opening 42. In some embodiments, the mounting hardware 44 may be required to be loosened to enlarge the first conductor receiving opening 40 and the second conductor receiving opening 42.

With the first grounding conductor 52 properly inserted into the first conductor receiving opening 40 and the second grounding conductor 54 properly inserted into the second conductor receiving opening 42, the mounting hardware 44 is tightened, causing the top wall 12 to move toward the bottom wall 14. Due to the shape and positioning of the side walls 16, 18 relative to the top wall 12 and bottom wall 14, the amount of torque required to move the top wall 12 toward the bottom wall 14 is controlled to allow for the mounting hardware 44 to be tightened without the need for special tooling.

As the mounting hardware 44 is tightened, the side wall engagement portion 22 frictionally engages the side wall 18. Consequently, the tightening of the hardware 44 and the movement of the top wall 12 causes the side wall 16 to pivot or rotate about the bottom wall 14. In addition, the tightening of the hardware 44 and the movement of the top wall 12 causes the side wall engagement portion 22 to force the side wall 18 to pivot or rotate about the bottom wall 14, which in turn causes the partitions 34 to move toward the bottom wall 14. The movement of the partitions 34 and the side wall 18 causes the first conductor receiving opening 40 to become smaller, allowing the partitions 34, the side wall 18 and the bottom wall 14 to mechanically and electrically engage the first grounding conductor 52 and retain the first grounding conductor 52 in the first conductor receiving opening 40. The movement of the top wall 12 and the side wall 16 causes the second conductor receiving opening 42 to become smaller, allowing the partitions 34, the side wall 16 and the top wall 12 to mechanically and electrically engage the second grounding conductor 54 and retain the second grounding conductor 54 in the second conductor receiving opening 42.

The configuration of the grounding terminal 10, including the side wall 16, side wall 18, side wall engagement portion 22 and legs 35 allows the grounding terminal 10 to be resiliently deformed as the hardware 44 is tightened for installation to a device for shipping, without taking a permanent set. This allows the grounding terminal 10 to return toward it original, unstresses position when the mounting hardware 44 is loosened, allowing the grounding terminal 10 to be used as intended for final permanent termination.

Figure 5:
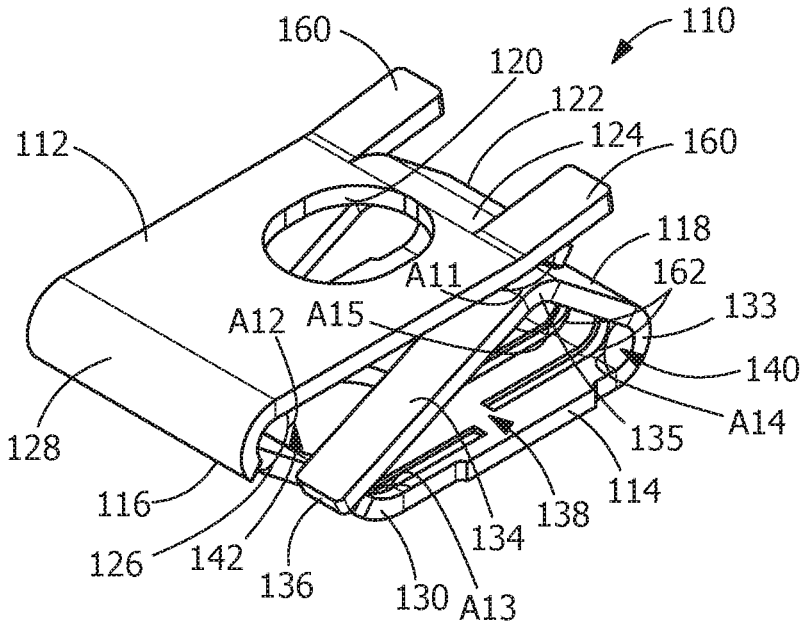
FIG. 5 is a top perspective view of an alternate illustrative grounding terminal of the present invention.
Figure 6:
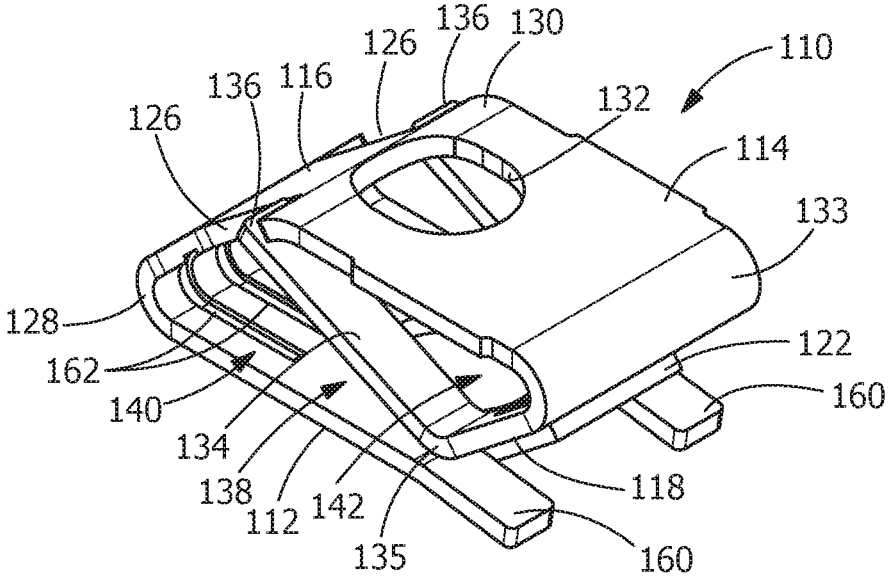
FIG. 6 is a bottom perspective of the alternate grounding terminal of FIG. 5.

An alternate embodiment of the grounding terminal 110 is shown in FIGS. 5 and 6, The grounding terminal 110 has a top wall 112, a bottom wall 114, a first side wall 116 and a second side wall 118. In the illustrative embodiment shown, the side walls 116, 118 extend at an angle other than 90 degrees from the top wall 112 and the bottom wall 114 to form a trapezoidal shape when viewed from the side of the grounding terminal 110. However, other shapes of the grounding terminal 110 may be used without departing from the scope of the invention. The grounding terminal 110 is stamped and formed from a single piece of conductive material, such as, but not limited to 1/32 inch phosphor bronze. The configuration of the grounding terminal 110 allows for the terminal 110 to be formed using a progressive stamping die.

As best shown in FIG. 5, the top wall 112 has an opening 120 which extends therethrough. The opening 120 is dimensioned to receiving mounting hardware therein. A side wall engagement portion 122 extends from one end of the top wall 112. The side wall engagement portion 122 extends from the top wall 112 at an angle A11 of greater than 90 degrees. The side wall engagement portion 122 has an arcuate or curved transition portion 124 which extends from the top wall 112. Stabilization legs 160 extend from the top wall 112 on either side of the side wall engagement portion 122. The stabilization legs 160 are configured to extend out of the plane of the top wall 112 is a different direction than the side wall engagement portion 122 extend from the plane of the top wall 112.

Side wall 116 extends from the opposite end of the top wall 112 from the side wall engagement portion 122. The side wall 116 extends at an angle A12 of less than 90 degrees from the top wall 112 and an angle A13 of greater than 90 degrees from the bottom wall 114. Recesses 126, as best shown in FIG. 4, are provided on either side of the side wall 116. The side wall 116 has an arcuate or curved transition portion 128 which extends from the top wall 112 and an arcuate or curved transition portion 130 which extends from the bottom wall 114.

The bottom wall 114 has an opening 132 which extends therethrough. The opening 132 is aligned with the opening 120 of the top wall 112. The opening 132 is dimensioned to receiving mounting hardware therein.

Side wall 118 extends from the opposite end of the bottom wall 114 from the side wall 116. The side wall 118 extends at an angle A14 of less than 90 degrees from the bottom wall 114. The side wall 118 is positioned proximate to the top wall 112 and forms an angle of greater than 90 degrees with the top wall 112, The side wall 118 has an arcuate or curved transition portion 133 which extends from the bottom wall 114 and an arcuate or curved transition portion 135 positioned proximate the top wall 112.

Extending from the end of the side wall 118 which is proximate to the top wall 112 are divider legs or partitions 134. In the embodiment shown two divider partitions 134 are provided. The partitions 134 extend at an angle A15 of greater than 90 degrees from the side wall 118. The partitions 134 extend from the end of the side wall 118 which is proximate to the top wall 112 toward the intersection of the side wall 116 and the bottom wall 114, Ends 136 of the legs are extend through or are positioned in the recesses 126 of the side wall 116.

The partitions 134 extend diagonally in an opening 138 formed by the top wall 112, the bottom wall 114, the side wall 116 and the side wall 118 to divide the opening 138 into a first conductor receiving opening 140 and a second conductor receiving opening 142. The partitions 134 are spaced apart a sufficient distance to allow the mounting hardware (not shown, but similar to mounting hardware 44) to extend through the opening 120 in the top wall 112, the opening 138 and the opening 132 in the bottom wall 114.

In use, the grounding terminal 110 is positioned in engagement with a grounding surface and operates in a similar manner to that described with respect to FIGS. 3 and 4. Either the top wall 112 or the bottom wall 114 may be placed in mechanical and electrical engagement with the grounding surface. If the top wall 112 is place in engagement with the grounding surface, the stabilization legs 160 engage the grounding surface and act as anti-rotation and stabilization features. Alternatively, other features such as, but not limited to, dimples may be provided on the top wall 112 and/or bottom wall 114 to engage the grounding surface and provide a friction or interference fit therebetween to better control the rotation of the terminal 110 as the terminal 110 is secured to the grounding surface.

Serrations 162 may also be provided on the inside surfaces of the opening 138. The serrations 162 may be, for example, indentations or sheared out from the grounding terminal 110. The serrations 162 are provided to grasp the grounding conductor (not shown, but similar to 52) to provide an optimal tensile grip and electrical connection when the grounding conductor is terminated to the grounding terminal 110.

Advantages of the terminals 10, 110 of the present invention include, but are not limited to, the grounding terminal 10, 110 requires only a single mounting hardware 44, such as a screw, whereby the single screw holds the grounding terminal 10, 110 in place on the grounding surface 50 until the grounding conductor 52 is placed in the opening 38, 138 and clamped in place by final torqueing down of the single screw. In addition, because of the direct flow of current from the grounding conductor 52 to the grounding surface 50, the grounding terminal 10, 110 can be made from lower cost materials, as the grounding current passes directly from the grounding surface 50 to the grounding conductor 52 with minimal load through grounding terminal material 10, 110. The grounding terminal 10, 110 can also be used at end of the grounding conductor 52 or mid-conductor for daisy chaining. The grounding terminal 10, 110 can be screwed onto the grounding surface 50 upside up or upside down.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments,

The invention claimed is:

1. A grounding terminal for mounting on a grounding surface, the grounding terminal comprising:

a top wall having a first mounting opening;

a bottom wall having a second mounting opening, the second mounting opening being in alignment with the first mounting opening to receive mounting hardware therethrough;

a first side wall extending between the top wall and the bottom wall, the first side wall extending from the top wall and the bottom wall at angles other than 90 degrees;

a second side wall extending between the top wall and the bottom wall, the second side wall extending from the top wall and the bottom wall at angles other than 90 degrees; and a side wall engagement portion extends from one end of the top wall, the side wall engagement portion extends from the top wall at an angle of greater than 90 degrees, the side wall engagement portion cooperates with the second side wall.

2. The grounding terminal as recited in claim 1, wherein the top wall is parallel to the bottom wall and the first side wall is parallel to the second side wall to form a trapezoidal shape.

3. The grounding terminal as recited in claim 1, wherein the side wall engagement portion has a curved transition portion which extends from the top wall.

4. The grounding terminal as recited in claim 1, wherein the first side wall extends from the opposite end of the top wall from the side wall engagement portion, the first side wall extends at an angle of less than 90 degrees from the top wall and an angle of greater than 90 degrees from the bottom wall.

5. The grounding terminal as recited in claim 1, wherein recesses are provided on the first side wall, the first side wall has a first curved transition portion which extends from the top wall and a second curved transition portion which extends from the bottom wall.

6. The grounding terminal as recited in claim 5, wherein the second side wall extends from the opposite end of the bottom wall from the first side wall, the second side wall extends at an angle of less than 90 degrees from the bottom wall, the second side wall is positioned proximate to the top wall and forms an angle of greater than 90 degrees with the top wall.

7. The grounding terminal as recited in claim 6, wherein the second side wall has a curved transition portion which extends from the bottom wall and a curved transition portion positioned proximate the top wall.

8. The grounding terminal as recited in claim 1, wherein partitions extend from the second side wall which is proximate to the top wall.

9. The grounding terminal as recited in claim 8, wherein the partitions extend at an angle of less than 90 degrees from the second side wall, the partitions extend from the end of the second side wall which is proximate to the top wall toward the intersection of the first side wall and the bottom wall.

10. The grounding terminal as recited in claim 9, wherein ends of the partitions extend through or are positioned in recesses of the first side wall.

11. The grounding terminal as recited in claim 10, wherein the partitions extend diagonally in a receiving opening formed by the top wall, the bottom wall, the first side wall and the side wall to divide the opening into a first conductor receiving opening and a second conductor receiving opening.

12. The grounding terminal as recited in claim 11, wherein the partitions are spaced apart a sufficient distance to allow the mounting hardware to extend through the first mounting opening in the top wall, the receiving opening and the second mounting opening in the bottom wall.

13. The grounding terminal as recited in claim 1, wherein stabilization legs extend from the top wall.

14. The grounding terminal as recited in claim 1, wherein serrations are provided on the inside surfaces of the receiving opening, the serrations penetrate a grounding conductor positioned in the receiving opening.

15. A grounding terminal for mounting on a grounding surface, the grounding terminal comprising:

a top wall having a first mounting opening;

a bottom wall having a second mounting opening, the second mounting opening being in alignment with the first mounting opening to receive mounting hardware therethrough;

a first side wall extending between the top wall and the bottom wall, the first side wall extending from the top wall and the bottom wall at angles other than 90 degrees, recesses provided on the first side wall, the first side wall having a first curved transition portion extending from the top wall and a second curved transition portion which extends from the bottom wall;

a second side wall extending between the top wall and the bottom wall, the second side wall extending from the top wall and the bottom wall at angles other than 90 degrees, the second side wall having a curved transition portion extending from the bottom wall and a curved transition portion positioned proximate the top wall;

the first side wall extends from the opposite end of the top wall from a second side wall engagement portion, the first side wall extends at an angle of less than 90 degrees from the top wall and an angle of greater than 90 degrees from the bottom wall; and partitions extending from the side wall toward the first side wall.

16. The grounding terminal as recited in claim 15, wherein the second side wall extends from the opposite end of the bottom wall from the first side wall, the second side wall extends at an angle of less than 90 degrees from the bottom wall, the second side wall is positioned proximate to the top wall and forms an angle of greater than 90 degrees with the top wall.

17. The grounding terminal as recited in claim 16, wherein the partitions extend diagonally in a receiving opening formed by the top wall, the bottom wall, the first side wall and the side wall to divide the opening into a first conductor receiving opening and a second conductor receiving opening.

18. The grounding terminal as recited in claim 17, wherein stabilization legs extend from the top wall.

19. A grounding terminal for mounting on a grounding surface, the grounding terminal comprising:

a top wall having a first mounting opening;

a bottom wall having a second mounting opening, the second mounting opening being in alignment with the first mounting opening to receive mounting hardware therethrough;

a first side wall extending between the top wall and the bottom wall, the first side wall extending from the top wall and the bottom wall at angles other than 90 degrees;

a second side wall extending between the top wall and the bottom wall, the second side wall extending from the top wall and the bottom wall at angles other than 90 degrees; and partitions extending from the second side wall which is proximate to the top wall.

20. The grounding terminal as recited in claim 19, wherein recesses are provided on the first side wall, ends of the partitions extend through or are positioned in the recesses of the first side wall, the partitions extend diagonally in a receiving opening formed by the top wall, the bottom wall, the first side wall and the side wall to divide the opening into a first conductor receiving opening and a second conductor receiving opening.

* * * * *